United States Patent [19]

Daniels

[11] 4,020,609

[45] May 3, 1977

[54] SHUTTER CONSTRUCTION

[75] Inventor: Phillip D. Daniels, West Bloomfield, Mich.

[73] Assignee: Novi Plastics Company, Novi, Mich.

[22] Filed: Mar. 24, 1976

[21] Appl. No.: 669,996

[52] U.S. Cl. ..... 52/473; 52/511; 52/656

[51] Int. Cl.[2] ..... E06B 7/08

[58] Field of Search ..... 52/507, 511, 506, 473, 52/510, 512, 629, 475, 656

[56] References Cited

UNITED STATES PATENTS

| | | | |
|---|---|---|---|
| 3,461,629 | 8/1969 | Smith | 52/629 X |
| 3,797,186 | 3/1974 | Smith | 52/473 X |

*Primary Examiner*—Price C. Faw, Jr.
*Assistant Examiner*—Carl D. Friedman
*Attorney, Agent, or Firm*—Cullen, Settle, Sloman & Cantor

[57] ABSTRACT

A louvered shutter of molded plastic adapted for mounting on a building wall and including a body and a peripheral flange, the improvement which comprises a corner reinforcing and mounting block, nested and secured within the internal corners of the shutter and secured thereto. Each corner block includes a honeycomb base and a pheripheral flange. The base defines a series of apertures to selectively receive a fastener which extends through the shutter corner, through an aperture in the corner block and into said wall.

4 Claims, 7 Drawing Figures

FIG. 1
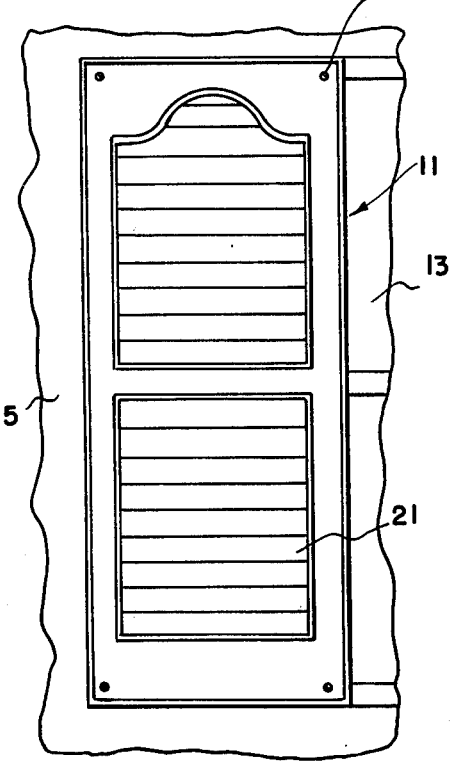
FIG. 2
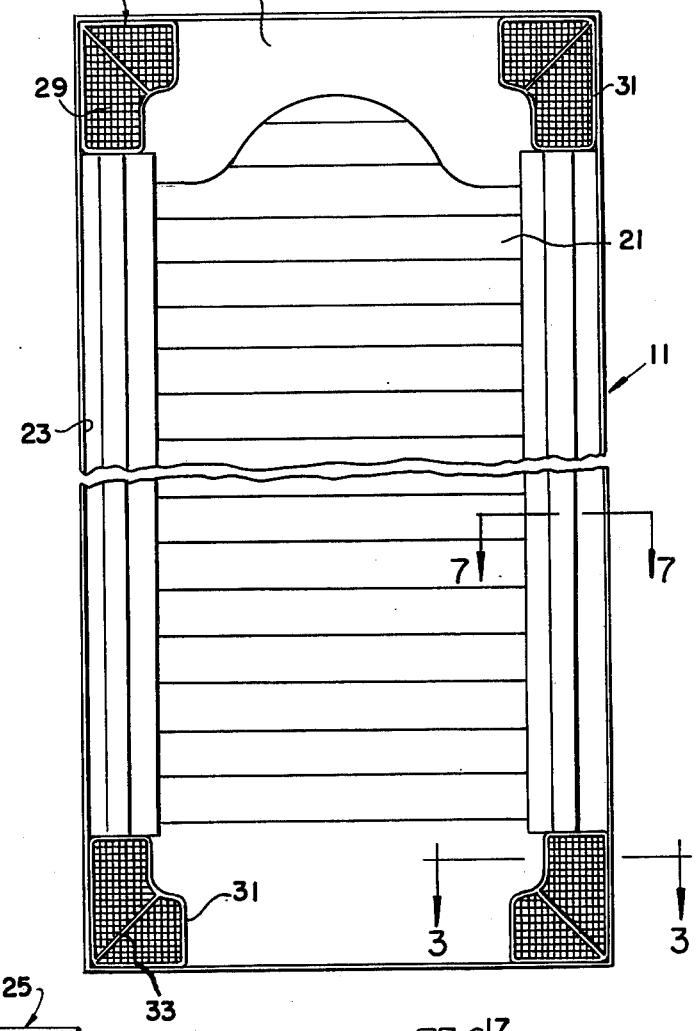
FIG. 5
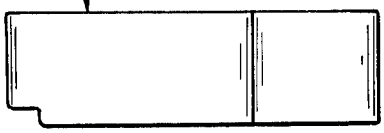
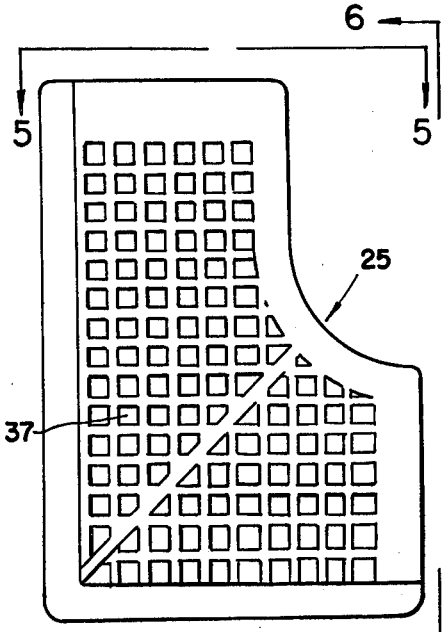
FIG. 4
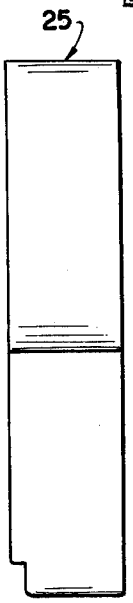
FIG. 6
FIG. 3
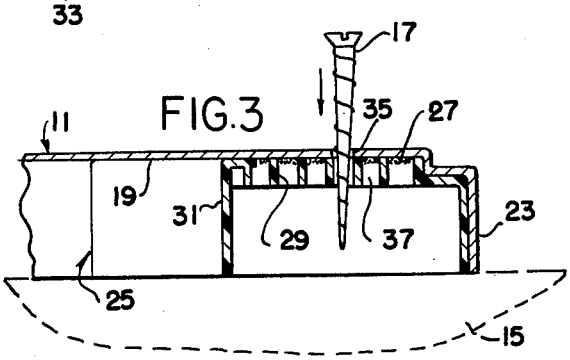
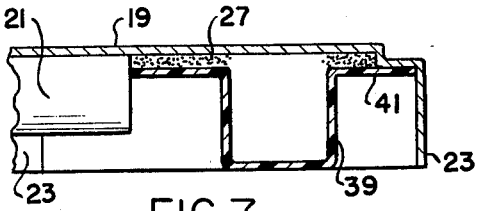
FIG. 7

SHUTTER CONSTRUCTION

BACKGROUND OF THE INVENTION

In the art, molded and preformed louvered shutters with a peripheral flange have been marketed and used in conjunction with building walls adjacent a window or door. Various mechanisms have been employed in an effort to firmly secure the shutters in place without damage to the shutter. The difficulty with using an ordinary fastener with respect to a shutter is that the plastic material making up the shutter is relatively brittle, being formed of a ABS plastic, or the like, and these shutters can crack and be damaged by the ordinary application of merely a screw or nail or other fastener. Various types of clips have been used heretofore for mounting the shutter to the building wall and these clips are often times preset upon the building wall, difficult at best, and the shutter is snap-fastened onto the clip in one manner or another. In one of these clip constructions, there is a U-shaped clip with a base which is adjustably mounted upon the building wall and secured thereto and then the peripheral flange of the shutter projected thereover.

The difficulty further experienced in the use of ordinary fasteners for the hollow type of molded plastic louvered shutter is that it is necessry that the screws or nails not be forced too tight since there also, it will cause flexing of the shutter and possible fracture. In some of these shutter constructions, a prefabricated wood frame is first mounted upon the building structure at the correct location and the shutter is snap-fastened thereover by inturned flanges upon the side flanges of the shutter which snap around the wood frame. Other types of adjustable clips have been first mounted upon the wall structure in order to receive the shutter but there has always been the difficulty of proper location of the clips. Some constructions have incorporated a framework which is reinforced in one manner or another to prevent damage to the shutter and stiffners have been used along the marginal edges.

BRIEF DESCRIPTION OF THE INVENTION

It is the object of the present invention to provide an improved corner reinforcing and mounting block for hollow molded plastic louvered shutters.

It is another object to provide an improved corner reinforcing and mounting block which is nested within the internal corners of the frame and secured therein as by adhesive or the like and which includes a honeycomb structure with multiple apertures adapted to receive fasteners in such a manner as to not only reinforce the shutter structure but to facilitate the anchoring and mounting of the shutter upon the building wall.

These and other objects will be seen from the following specification and claims in conjunction with the appended drawing.

THE DRAWING

FIG. 1 is a fragmentary front elevational view of a building wall adjacent a door or window to which has been attached the present louvered shutter;

FIG. 2 is a partly broken away rear elevational view of the molded shutter with the present improved corner reinforcing and mounting blocks secured in place;

FIG. 3 is a fragmentary section taken in the direction of arrows 3—3 of FIG. 2, on an increased scale, and illustrating the mounting of the shutter by a fastener with respect to a building wall, fragmentarily shown;

FIG. 4 is a plan view of a corner reinforcing and mounting block shown in FIG. 2, on an increased scale;

FIG. 5 is an end view taken in the direction of arrows 5—5 of FIG. 4;

FIG. 6 is a side view taken in the direction of arrows 6—6 of FIG. 4;

FIG. 7 is a fragmentary section taken in the direction of arrows 7—7 of FIG. 2, on an increased scale.

It will be understood that the above drawing illustrates merely a preferred embodiment of the invention, and that other embodiments are contemplated within the scope of the claims hereafter set forth.

DETAILED DESCRIPTION OF THE INVENTION

Referring to the drawing, a shutter is shown at 11, FIG. 1, adjacent a window 13, or door in a building wall or siding 15 secured upon said wall by a series of fasteners 17.

The louvered shutter has a molded body 19 of a suitable plastic material, such as ABS, and which includes as a part thereof a series of simulated louvers 21 and the peripheral outturned continuous flange 23.

The present invention is directed to a method of reinforcing and securing the shutter upon building wall 15 using fasteners 17 and incorporating a series of corner blocks 25 which are nested within the internal corners of the shutter and secured against the shutter body and against the flange 23 by a suitable cement or plastic adhesive 27.

Each of the corner blocks have a plastic body formed of polypropelene or similar plastic and which includes a honeycombed base 29 defining series of fastener receiving apertures 37 as well as a peripheral flange 31. As shown particularly in FIG. 3, the corner block is essentially cup-shaped and includes an open-ended honeycombed base. The honeycombed structure of the corner block defines a grid of apertures extending essentially perpendicular to the plane of the body, with the apertures being sized to receive a conventional fastener, such as a nail or screw. An internal reinforcing flange 33 extends across the interior portion of the corner block between diametrically opposed portions of the corner block body directly adjacent the honeycombed portion 29. The height of the flanges, including peripheral flange 31 and the divider flange 33, when assembled within the shutter corners and secured thereto, is substantially equal to the internal height of the shutter flange 23.

This is for the purpose of protectively reinforcing the hollow plastic shutter corners at the point where fasteners 17 are to be received.

In the assembly of the shutter to the building wall, a suitable power or other drill is employed for making the openings 35 within the shutter body to receive the fasteners such as screws 17 shown in FIG. 3. Normally the holes 35 are formed in corner portions of the shutter so as to project through at least one of the honeycomb apertures 37 and for projection into the building wall 15, such as shown in FIGS. 1 and 3.

Though not a part of the present invention, the present shutter does include the reinforcing and stiffening spacer or channel 39 which extends along the sides of the shutter between the corner blocks. These stiffeners include outturned flanges 41 which register with the interior wall of the shutter body 19 and are secured thereto using a suitable plastic cement or other adhesive as at 27, FIG. 7.

By the present construction, once the location of the shutter has been predetermined and the holes drilled at 35, it becomes a simple matter to anchor the shutter to the building wall by projecting the fastener 17 through the predrilled hole 35 which will selectively enter one of the apertures 37 in the honeycomb corner block for easy projection into the building wall 15.

This will effectively anchor the shutter upon the building wall and at the same time, will prevent fracture or damage to the shutter body.

Having described my invention, reference should now be had to the following claims.

I claim:

1. In a louvered shutter of molded plastic material adapted for registry with a building wall, the shutter being essentially a shell comprised of a generally planar body including louvers and a continuous peripheral flange; the improvement comprising:

a corner reinforcing and mounting block nested within each of the internal corners of the shutter at its sides adjacent said flange and secured to said body;

said corner block being essentially cup-shaped and having a body with an open-ended honeycombed base and a peripheral flange;

the honeycomb structure of the corner block base defining a grid of apertures extending essentially perpendicular to the plane of the body and being sized to receive a conventionally sized fastener, such as a nail or screw, to facilitate securement of the shutter to a building wall; and the corner block providing reinforcement for the shutter.

2. In the shutter of claim 1, the securing of said corner blocks to said shutter body including an adhesive.

3. In the shutter of claim 1, the flange of said corner block extending to the edge of said shutter flange.

4. In the shutter of claim 1, a divider flange extending across said corner block body of a height corresponding to the corner block flange, said corner block flanges corresponding to the height of the shutter flange to firmly space corner portions of said shutter from said building wall.

* * * * *